US008838460B2

(12) United States Patent
Choi et al.

(10) Patent No.: US 8,838,460 B2
(45) Date of Patent: Sep. 16, 2014

(54) APPARATUS FOR PLAYING AND PRODUCING REALISTIC OBJECT AUDIO

(75) Inventors: Byeong Ho Choi, Yongin-si (KR); Je Woo Kim, Seongnam-si (KR); Charles Hyok Song, Gwangju-si (KR); Choong Sang Cho, Seongnam-si (KR)

(73) Assignee: Korea Electronics Technology Institute, Seongnam-si (KR)

( * ) Notice: Subject to any disclaimer, the term of this patent is extended or adjusted under 35 U.S.C. 154(b) by 631 days.

(21) Appl. No.: 13/078,586

(22) Filed: Apr. 1, 2011

(65) Prior Publication Data

US 2011/0246207 A1 Oct. 6, 2011

(30) Foreign Application Priority Data

Apr. 2, 2010 (KR) ..... 10-2010-0030408

(51) Int. Cl.
*G10L 19/00* (2013.01)
*G10L 19/008* (2013.01)

(52) U.S. Cl.
CPC ..... *G10L 19/008* (2013.01)
USPC ..... 704/500; 704/220; 704/270; 700/94; 370/466

(58) Field of Classification Search
USPC ..... 704/500, 220, 270; 700/94; 370/466
See application file for complete search history.

(56) References Cited

U.S. PATENT DOCUMENTS

| | | | | |
|---|---|---|---|---|
| 7,363,497 | B1 * | 4/2008 | Ferguson | 713/176 |
| 2002/0106986 | A1 * | 8/2002 | Asada et al. | 455/3.01 |
| 2003/0228138 | A1 * | 12/2003 | Tanaka et al. | 386/96 |
| 2004/0111171 | A1 * | 6/2004 | Jang et al. | 700/94 |

FOREIGN PATENT DOCUMENTS

| | | | |
|---|---|---|---|
| EP | 1416769 | A1 | 5/2004 |
| KR | 10-2004-0037437 | A | 5/2004 |
| KR | 10-2008-0095928 | A | 10/2008 |

OTHER PUBLICATIONS

Engdegard et al. "Spatial Audio Object Coding (SAOC)—The Upcoming MPEG Standard on Parametric Object Based Audio Coding" Audio Engineering Society, May 17-20, 2008 Amsterdam, The Netherlands.*

Kang et al., "The Design of Object-Based 3D Audio Broadcasting System," The Journal of the Acoustical Society of Korea, 2003, vol. 7, pp. 592-602.

Korean Patent Office, Korean Notice of Allowance issued in corresponding KR Application No. 10-2010-0030408, dated Nov. 23, 2011.

Yoo et al., "Object-Based 3D Audio Broadcasting System for Interactive Broadcasting Services," Journal of Korea Multimedia Society, 2006, vol. 10, No. 2, pp. 84-96.

* cited by examiner

*Primary Examiner* — Vincent P Harper
(74) *Attorney, Agent, or Firm* — Sughrue Mion, PLLC

(57) ABSTRACT

Disclosed is an apparatus for playing and producing realistic object audio. The apparatus for playing realistic object audio includes: a deformatter unit individually separating scene description (SD) compression data and object audio compression data from inputted audio files; an SD decoding unit decoding the SD compression data to restore SD information; an object audio decoding unit decoding the object audio compression data to restore object audio signals which are respective audio signals of a plurality of objects; and an object audio effect unit adding an audio effect for each object to the object audio signals according to SD information for each object corresponding to the object audio signals among the SD information to produce a realistic object audio signal corresponding to each of the object audio signals.

9 Claims, 12 Drawing Sheets

APPARATUS FOR PLAYING AND PRODUCING REALISTIC OBJECT AUDIO

CROSS-REFERENCE TO RELATED APPLICATIONS

This application claims priority under 35 U.S.C. §119 to Korean Patent Application No. 10-2010-0030408, filed on Apr. 2, 2010, in the Korean Intellectual Property Office, the disclosure of which is incorporated herein by reference in its entirety.

TECHNICAL FIELD

The present invention relates to an apparatus for playing and producing realistic object audio, and more particularly, to an apparatus for playing and producing realistic object audio that allows a user to produce and play various sounds for each object.

BACKGROUND

In general, an audio service provided through a radio, an MP3, a CD, and the like synthesizes signals acquired from two to dozens of sound sources according to the sound sources, and stores and plays the synthesized signals as mono and stereo signals, 5.1-channel signals, and the like.

In the audio service, a user can interact with sound sources given through control of volume, and band amplification and attenuation through an equalizer.

However, in the case of a signal in which dozens of sound sources generated by a plurality of objects are synthesized into one sound source, the user cannot individually control only a sound source generated by a predetermined object or control a sound effect.

In order to overcome disadvantages, object-based audio service technology has been developed in recent years. The object-based audio service technology individually provides objects and information corresponding to the sound effect and volume required for each object to the user to allow the user to directly synthesize a sound source of each object. That is, at the time of producing audio contents, a service provider does not synthesize the signal corresponding to the sound source of each object.

Scene description (SD) information for synthesizing compression information for each object and each object is required in the object-based audio service. Audio codecs such as an MPEG-1,2,2.5 layer 3 (MP3), advanced audio coding (AAC), MPEG-4 audio lossless coding (ALS), and the like may be used in the compression information for each object. However, SD information producing technology for producing the SD information and SD information producing technology for integrating and analyzing the produced SD information and an audio signal for each object are required. That is, the known audio playing and producing apparatus processes a sound by downmixing the audio signal for each object for multi-channel audio objects. Therefore, the known audio playing and producing apparatus cannot integrate and analyze the audio signal for each object and the SD information for each object.

SUMMARY

An exemplary embodiment of the present invention provides an apparatus for playing realistic object audio, the apparatus including: a deformatter unit individually separating scene description (SD) compression data and object audio compression data from inputted audio files; an SD decoding unit decoding the SD compression data to restore SD information; an object audio decoding unit decoding the object audio compression data to restore object audio signals which are respective audio signals of a plurality of objects; and an object audio effect unit adding an audio effect for each object to the object audio signals according to SD information for each object corresponding to the object audio signals among the SD information to produce a realistic object audio signal corresponding to each of the object audio signals.

Another exemplary embodiment of the present invention provides an apparatus for producing realistic object audio, the apparatus including: a deformatter unit individually separating scene description (SD) compression data and object audio compression data from inputted audio files; a user SD inputting unit receiving user SD information by user setting; a user SD encoding unit encoding the user SD information to user SD compression data; and a user file formatter unit integrating the SD compression data, the object audio compression data, and the user SD compression data into an audio file.

Other features and aspects will be apparent from the following detailed description, the drawings, and the claims.

DETAILED DESCRIPTION OF EMBODIMENTS

Figure 1:
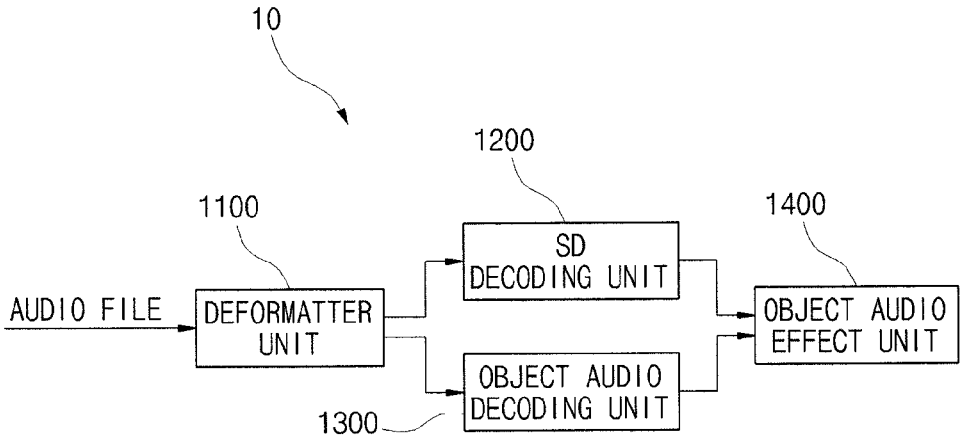
FIG. 1 is a block diagram showing an apparatus for playing realistic object audio according to an exemplary embodiment of the present invention.

Hereinafter, exemplary embodiments will be described in detail with reference to the accompanying drawings. Throughout the drawings and the detailed description, unless otherwise described, the same drawing reference numerals will be understood to refer to the same elements, features, and structures. The relative size and depiction of these elements may be exaggerated for clarity, illustration, and convenience. The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

Figure 2:
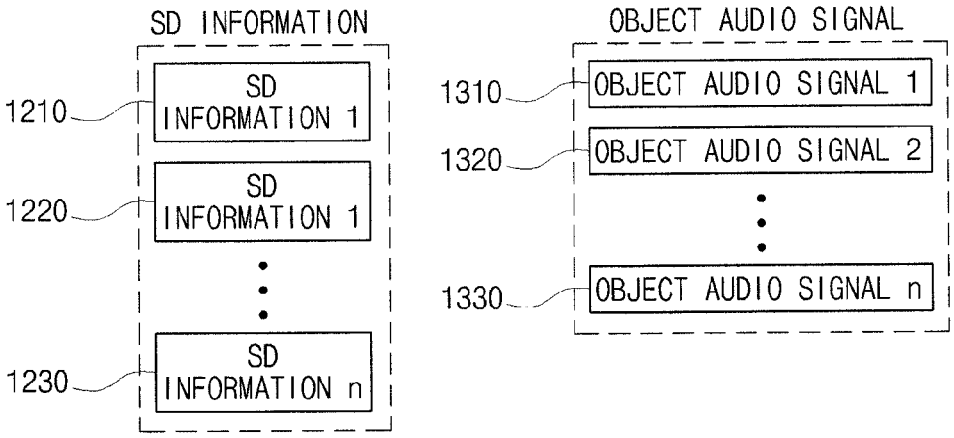
FIG. 2 is a diagram showing SD information and an object audio signal produced by an SD decoding unit and an object audio decoding unit shown in FIG. 1, respectively.

FIG. 1 is a block diagram showing an apparatus for playing realistic object audio according to an exemplary embodiment of the present invention, and FIG. 2 is a diagram showing SD information and an object audio signal produced by an SD decoding unit and an object audio decoding unit shown in FIG. 1, respectively.

Referring to FIGS. 1 and 2, a realistic object audio playing apparatus 10 according to an exemplary embodiment of the present invention includes a deformatter unit 1100, an SD decoding unit 1200, an object audio decoding unit 1300, and an object audio effect unit 1400.

The deformatter unit 1100 individually separates scene description (SD) compression data and object audio compression data from inputted audio files.

The SD decoding unit 1200 decodes the SD compression data to produce SD information.

The object audio decoding unit 1300 decodes the object audio compression data to produce object audio signals 1310 to 1330 which are respective audio signals of a plurality of objects.

The object audio effect unit 1400 adds an audio effect for each object to each of the object audio signals 1310 to 1330 according to SD information 1210 to 1230 for each object corresponding to each of the object audio signals among the SD information to produce a realistic object audio signal corresponding to each object audio signal.

Meanwhile, the object audio signals 1310 to 1330 are the respective audio signals of the plurality of objects. In the case of music, each object may be a musical instrument used in playing the music. Further, each object audio signal may be an audio signal for each of the musical instruments.

Further, the SD information includes information for producing the realistic object audio signal by adding audio effects to the object audio signals 1310 to 1330. Herein, the audio effect may include the audio effect for each object. The audio effect for each object is an audio effect added to each object audio signal.

Furthermore, the SD information may include SD information 1210 to 1230 for objects.

Herein, the SD information 1210 to 1230 for the objects include audio effects individually applied to the object audio signals, respectively and contents regarding playing sections.

The SD information 1210 to 1230 for each object may include at least one of information regarding the number of audios for each object, name information of audio for each object, type information of audio for each object, effect information of audio for each object, effect application time information of audio for each object, volume information of audio for each object, angle and distance information of audio for each object, angle and distance information for an externalization effect of audio for each object, 3D effect information of audio for each object and parameter information for the 3D effect information, background information of audio for each object, application start time information of audio for each object, application termination time information of audio for each object, and playing-related time information of audio for each object and parameter information of audio for each object. Herein, the parameter information of audio for each object represents parameters which audio for each object can possess.

Further, the parameter information of audio for each object may include a reflection coefficient for an echo effect of audio for each object, and shape and size information of a space.

The parameter information of audio for each object may include angle information and distance information for an audio panning effect.

The parameter information of audio for each object may include characteristic parameter information of each object according to a characteristic of audio for each object.

Meanwhile, the background information of audio for each object represents a space (e.g., a theater, a house, or the like) where audio for each object is positioned.

The 3D effect information of audio for each object represents a 3D effect (e.g., the echo effect, the externalization effect, or the panning effect) of audio for each object.

The SD information decoded by the SD decoding unit 1200 includes a plurality of object information such as SD information 1 1210, SD information 2 1220, . . . , SD information n 1230.

Further, the object audio signals decoded by the object audio decoding unit 1300 include a plurality of object audio signals such as object audio signal 1 1310, object audio signal 2 1320, . . . , object audio signal n 1330.

Therefore, the object audio effect unit 1400 adds the audio effect for each object to the object audio signals according to the SD information for each object corresponding to each of the object audio signals among the SD information to produce the realistic object audio signal corresponding to each object audio signal.

For example, SD information 1 1210 may include the background information of audio for each object corresponding to object audio signal 1 1310.

When an object of object audio signal 1 1310 is a violin and SD information 1 1210 corresponding to object audio signal 1 1310 is effect information in which a predetermined object is played in a theater, the object audio effect unit 1400 may add the audio effect for each object to object audio signal 1 1310, similar to as if the violin is played in the theater and produce the realistic object audio signal. It can be applied even to SD information 2 1220 to SD information n similarly. Further, the number of object audio signals corresponding to one SD information may be one or more.

Meanwhile, the object audio effect unit 1400 may divide a time of each object audio signal to add the audio effect for each object according to the SD information for each object at the time of producing the realistic object audio signal corresponding to each object audio signal.

For example, the object audio effect unit 1400 may add the audio effect for each object, similar to as if object audio signal 1 1310 is played in a playground from 1 second to 3 seconds and add the audio effect for each object so as to maximize the volume of the audio for each object from 10 seconds to 20 seconds, according to the SD information for each object.

Therefore, the SD information 1210 to 1230 for each object may include the effect application time information of audio for each object, the application start time information of audio for each object, the application termination time information of audio for each object, and the playing-related time information of audio for each object in order to add the audio effect for each object by dividing the time of each of the object audio signals 1310 to 1330.

Meanwhile, as the SD compression data, MPEG-4 binary format for scenes (BIFs), MPEG-4 lightweight application scene representation (LASeR), and the like may be used.

Further, as the object audio compression data, audio codecs such as MPEG-1,2,2.5 layer 3 (MP3), advanced audio coding (AAC), MPEG-4 audio lossless coding (ALS), and the like may be used.

Accordingly, the user may add the SD information to the object audio signal and produce the realistic object audio signal by using the realistic object audio playing apparatus 10.

Figure 3:
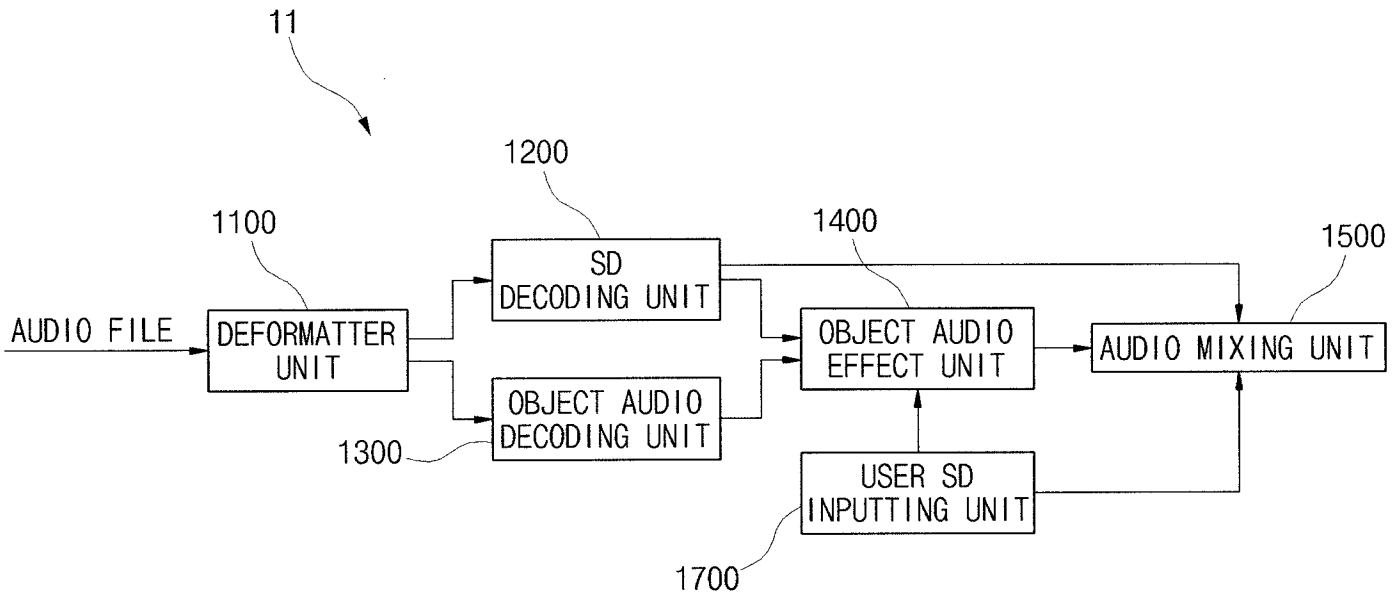
FIG. 3 is a block diagram showing an apparatus for playing realistic object audio according to another exemplary embodiment of the present invention.

FIG. 3 is a block diagram showing an apparatus for playing realistic object audio according to another exemplary embodiment of the present invention.

Referring to FIG. 3, a realistic object audio playing apparatus 11 according to another exemplary embodiment of the present invention includes a deformatter unit 1100, an SD decoding unit 1200, an object audio decoding unit 1300, an object audio effect unit 1400, and an audio mixing unit 1500.

Herein, the same reference numerals are used with respect to components that perform the same functions as the components shown in FIG. 1 and a detailed description of the corresponding components will be omitted.

The audio mixing unit 1500 synthesizes each of the realistic object audio signals into at least one sound.

Meanwhile, the SD information may further include object relationship SD information.

Herein, the object relationship SD information represents a relative relationship between objects. The object relationship SD information is used to synthesize the object audio signals.

The object relationship SD information may include at least one of synthesis ratio information of the object audio signals, relative positional information between object audios, type information of an effect applied to the synthesized sound and all the object audios, application time information of the effect applied to the synthesized sound and all the object audios, audio parameter information for the effect applied to the synthesized sound and all the object audios, 3D effect information applied to the synthesized sound, parameter information for the 3D effect information applied to the synthesized sound, angle information for an externalization effect of the synthesized sound, distance information for the externalization effect of the synthesized sound, audio mixing information for synthesizing the object audio signals, and volume control information among the object audios.

Herein, the audio parameter information represents parameters which the synthesized sound can possess.

The audio parameter information may include a reflection coefficient for an echo effect of the synthesized sound, and shape and size information of a space.

Further, the audio parameter information may include angle information and distance information for an audio panning effect of the synthesized sound.

Meanwhile, the relative positional information between the object audios may be represented by angle and distance information for each object.

Further, the audio mixing unit 1500 may synthesize the realistic object audio signals into at least one sound according to the object relationship SD information representing the relative relationship between the objects in the SD information.

Accordingly, the user may add the SD information to the object audio signal and produce the realistic object audio signal by using the realistic object audio playing apparatus 11. Further, the user may synthesize a plurality of realistic object audio signals.

Meanwhile, the realistic object audio playing apparatus 11 according to another exemplary embodiment of the present invention may further include a user SD inputting unit 1700.

The user SD inputting unit 1700 receives user SD information from the user.

Herein, the user SD information represents SD information inputted by the user. The user SD information corresponds to the SD information and has the same structure as the SD information. The user SD information may include at least one of the SD information for each object and the object relationship SD information.

Meanwhile, the object audio effect unit 1400 may add the audio effect for each object according to the SD information for each object corresponding to each object audio signal of the user SD information to produce the realistic object audio signal.

For example, when the user inputs effect information in which a predetermined object is played at home, as the user SD information and an object of the object audio signal corresponding thereto is a violin, the object audio effect unit 1400 may add the audio effect for each object to the object audio signal, similar to as if the violin is played at home and produce the realistic object audio signal.

Meanwhile, the user SD information may be independent from the SD information produced by the SD decoding unit 1200. Accordingly, the object audio effect unit 1400 may produce the realistic object audio signal without changing the SD information produced by the SD decoding unit 1200. Further, the object audio effect unit 1400 may use both the SD information produced by the SD decoding unit 1200 and the user SD information at the time of producing the realistic object audio signal.

Meanwhile, the audio mixing unit 1500 may synthesize the realistic object audio signals into at least one sound according to the object relationship SD information representing the relative relationship between the objects in the user SD information.

Therefore, the user inputs the SD information according to user preference to produce the realistic object audio signal. Further, since the user may produce the realistic object audio signal for each object, the user may produce various sounds.

Figure 4:
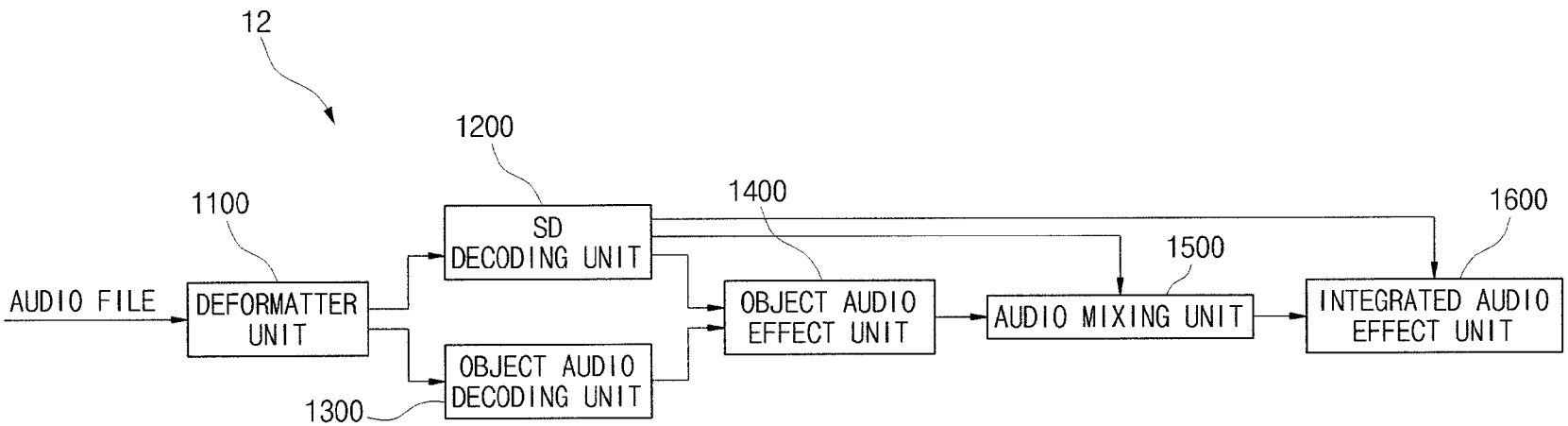
FIG. 4 is a block diagram showing an apparatus for playing realistic object audio according to yet another exemplary embodiment of the present invention.

FIG. 4 is a block diagram showing an apparatus for playing realistic object audio according to yet another exemplary embodiment of the present invention.

Referring to FIG. 4, a realistic object audio playing apparatus 12 according to yet another exemplary embodiment of the present invention includes a deformatter unit 1100, an SD decoding unit 1200, an object audio decoding unit 1300, an object audio effect unit 1400, an audio mixing unit 1500, and an integrated audio effect unit 1600.

Herein, the same reference numerals are used with respect to components that perform the same functions as the components shown in FIG. 3 and a detailed description of the corresponding components will be omitted.

The integrated audio effect unit 1600 adds an integrated audio effect to the sound produced from the audio mixing unit 1500.

Herein, the integrated audio effect is an audio effect for adding an effect to the sound synthesized by the audio mixing unit 1500. The integrated audio effect may be amplification control, a time axial control, and frequency control of the synthesized sound.

Meanwhile, the SD information and the user SD information may include integrated audio effect information. The integrated audio effect information represents the integrated audio effect.

The integrated audio effect information may include amplification control information, time axis control information, and frequency control information.

Further, the integrated audio effect information may include audio equalization information.

In addition, the integrated audio effect information may include echo effect information, externalization effect information, and panning effect information.

Therefore, the integrated audio effect unit 1600 receives the SD information from the SD decoding unit 1200 to add the integrated audio effect to the sound produced by the audio mixing unit 1500.

Figure 5:
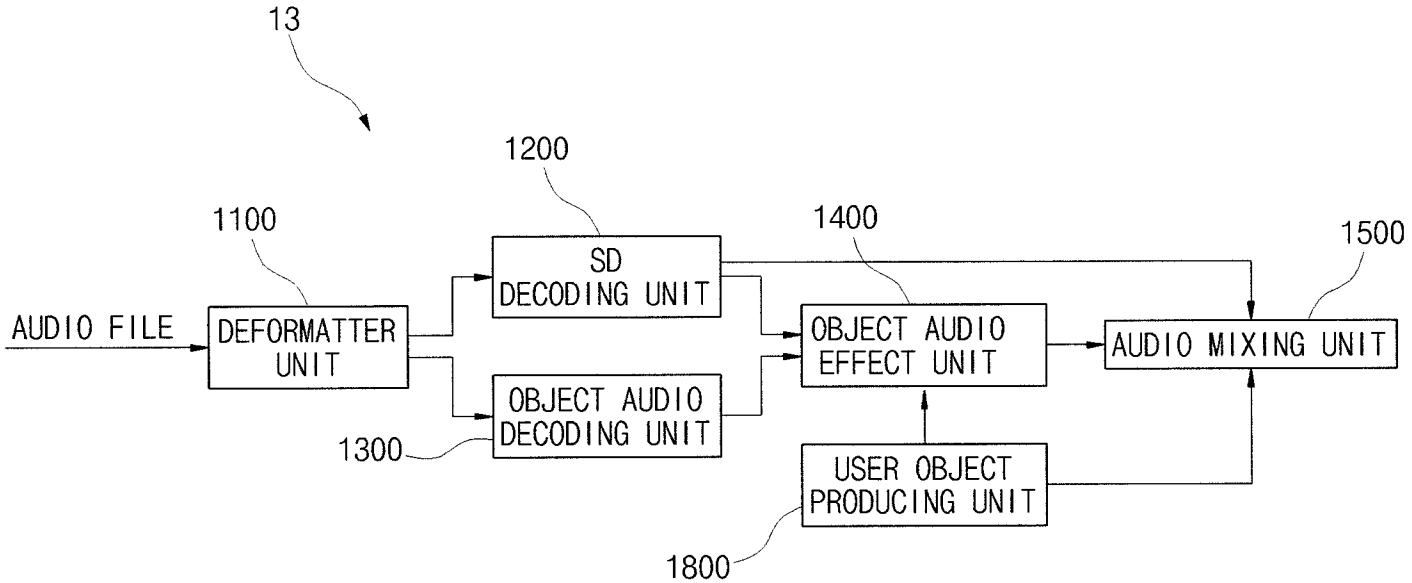
FIG. 5 is a block diagram showing an apparatus for playing realistic object audio according to yet another exemplary embodiment of the present invention.

FIG. 5 is a block diagram showing an apparatus for playing realistic object audio according to yet another exemplary embodiment of the present invention.

Referring to FIG. 5, a realistic object audio playing apparatus 13 according to yet another exemplary embodiment of the present invention includes a deformatter unit 1100, an SD decoding unit 1200, an object audio decoding unit 1300, an object audio effect unit 1400, an audio mixing unit 1500, and a user object producing unit 1800.

Herein, the same reference numerals are used with respect to components that perform the same functions as the components shown in FIG. 3 and a detailed description of the corresponding components will be omitted.

The user object producing unit 1800 adds object audio according to user input and stores a user object audio signal which is an audio signal of the added object audio.

Meanwhile, the object audio effect unit 1400 may further receive the user object audio signal and add the audio effect for each object to the object audio signal according to the SD information for each object to produce the realistic object audio signal corresponding to each object audio signal.

Meanwhile, the audio mixing unit 1500 further receives the user object audio signal and may synthesize the corresponding user object audio signal into at least one sound.

Further, the audio mixing unit 1500 may synthesize each realistic object audio signal into at least one sound according to the object relationship SD information including the information representing the relative relationship between the objects in the SD information.

Therefore, the user can produce the realistic object audio signal by adding the object audio according to user input in addition to the inputted audio file and play various sounds.

Meanwhile, the realistic object audio playing apparatus according to yet another exemplary embodiment of the present invention may not include the deformatter unit 1100, the SD decoding unit 1200, and the object audio decoding unit 1300 when the SD information and the object audio signal are inputted.

Specifically, the realistic object audio playing apparatus according to yet another exemplary embodiment of the present invention may include the object audio effect unit 1400 and the audio mixing unit 1500.

Herein, the object audio effect unit 1400 receives the scene description (SD) information and adds the audio effect for each object to the object audio signal according to the SD information for each object corresponding to each of the object audio signals among the SD information, to produce the realistic object audio signal corresponding to each object audio signal.

The audio mixing unit 1500 synthesizes each of the realistic object audio signals into at least one sound.

Meanwhile, the audio mixing unit 1500 may synthesize each realistic object audio signal into at least one sound according to the object relationship SD information including the information representing the relative relationship between the objects in the SD information.

Therefore, the user may produce the realistic object audio signal corresponding to each object audio signal by using the SD information.

Meanwhile, the realistic object audio playing apparatus according to yet another exemplary embodiment of the present invention may include the user SD inputting unit 1700 and the object audio effect unit 1400.

Herein, the user SD inputting unit 1700 receives the user SD information from the user.

The object audio effect unit 1400 adds the audio effect for each object to the object audio signals according to the SD information for each object corresponding to each of the object audio signals among the user SD information, to produce the realistic object audio signal corresponding to each object audio signal.

Therefore, the user inputs the user SD information to produce the realistic object audio signal according to user preference.

Meanwhile, the realistic object audio playing apparatus according to yet another exemplary embodiment of the present invention may include the user SD inputting unit 1700, the object audio effect unit 1400, and the audio mixing unit 1500.

Therefore, the user may input the user SD information to produce the realistic object audio signal according to user preference and synthesize each realistic object audio signal into one sound.

Figure 6:
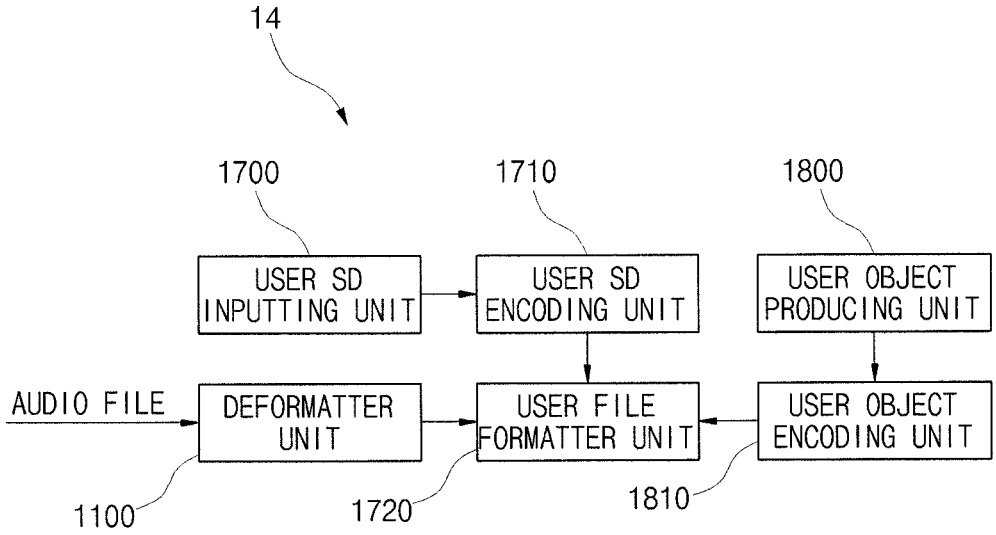
FIG. 6 is a block diagram showing an apparatus for encoding realistic object audio according to an exemplary embodiment of the present invention.

FIG. 6 is a block diagram showing an apparatus for encoding realistic object audio according to an exemplary embodiment of the present invention.

Referring to FIG. 6, a realistic object audio encoding apparatus 14 includes a deformatter unit 1100, a user SD inputting unit 1700, a user SD encoding unit 1710, and a user file formatter unit 1720.

The deformatter unit 1100 individually separates SD compression data and object audio compression data from inputted audio files.

The user SD inputting unit 1700 receives user SD information by user setting.

The user SD encoding unit 1710 encodes the user SD information to user SD compression data.

The user file formatter unit 1720 integrates SD compression data, object audio compression data, and user SD compression data into an audio file.

Therefore, the user may encode the inputted user SD information into the user SD compression data by using the realistic object audio encoding apparatus 14 and add the corresponding user SD compression data to the inputted audio file. Further, the user integrates the user SD information into the inputted audio file to store the user SD information in the audio file and reuse the user SD information.

Referring to FIG. 6, the realistic object audio encoding apparatus 14 may further include a user object audio producing unit 1800 and a user object encoding unit 1810.

The user object producing unit 1800 adds object audio according to user input and stores a user object audio signal which is an audio signal of the added object audio.

The user object encoding unit 1810 encodes the user object audio signal into user object audio compression data.

The user file formatter unit 1720 may receive the user object audio compression data from the user object encoding unit 1810 to integrate the SD compression data, the object audio compression data, and the user object audio compression data into the audio file.

Therefore, the user integrates the user object audio signal into the inputted audio file to store the user object audio signal in the audio file and reuse the user object audio signal.

Figure 7:
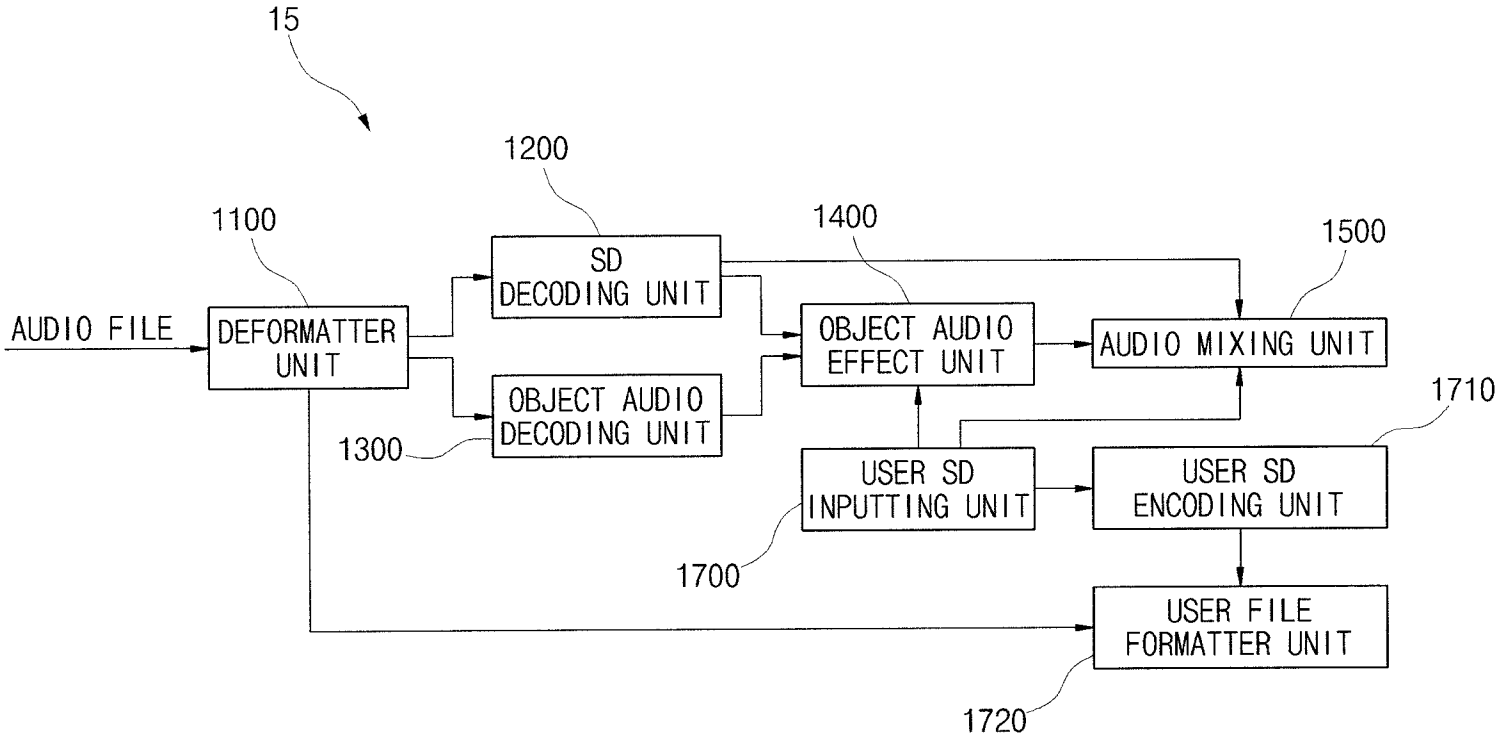
FIG. 7 is a block diagram showing an apparatus for encoding realistic object audio according to another exemplary embodiment of the present invention.

FIG. 7 is a block diagram showing an apparatus for encoding realistic object audio according to another exemplary embodiment of the present invention.

Referring to FIG. 7, a realistic object audio encoding apparatus 15 includes a deformatter unit 1100, a SD decoding unit 1200, an object audio decoding unit 1300, an object audio effect unit 1400, an audio mixing unit 1500, a user SD inputting unit 1700, a user SD encoding unit 1710, and a user file formatter unit 1720.

Herein, the same reference numerals are used with respect to components that perform the same functions as the components shown in FIGS. 3 and 6 and a detailed description of the corresponding components will be omitted.

The realistic object audio encoding apparatus 15 may easily find the realistic object audio signal to which the user SD information is added and the synthesized sound by using the SD decoding unit 1200, the object audio decoding unit 1300, the object audio effect unit 1400, and the audio mixing unit 1500 of the realistic object audio playing apparatus according to the exemplary embodiments of the present invention.

Herein, the object audio effect unit 1400 adds the audio effect for each object to the object audio signal according to the SD information for each object in the user SD information received from the user SD inputting unit 1700 to produce the realistic object audio signal corresponding to the object audio signal.

Meanwhile, the user SD information may include at least one of the SD information for each object corresponding to the object audio signal, the object relationship SD information including the information representing the relative relationship between the objects, and the integrated audio effect information representing the integrated audio effect for adding the effect to the integrated sound of the object.

Further, the audio mixing unit 1500 may synthesize each realistic object audio signal into at least one sound according to the object relationship SD information including the information representing the relative relationship between the objects in the user SD information.

Therefore, the user may encode the inputted user SD information into the user SD compression data by using the realistic object audio encoding apparatus 15 and add the corresponding user SD compression data to the inputted audio file. Further, the user integrates the user SD information into the inputted audio file to store the user SD information in the audio file and reuse the user SD information. Further, the user may easily find the realistic object audio signal to which the user SD information is added and the synthesized sound by using the object audio effect unit 1400 and the audio mixing unit 1500.

Figure 8:
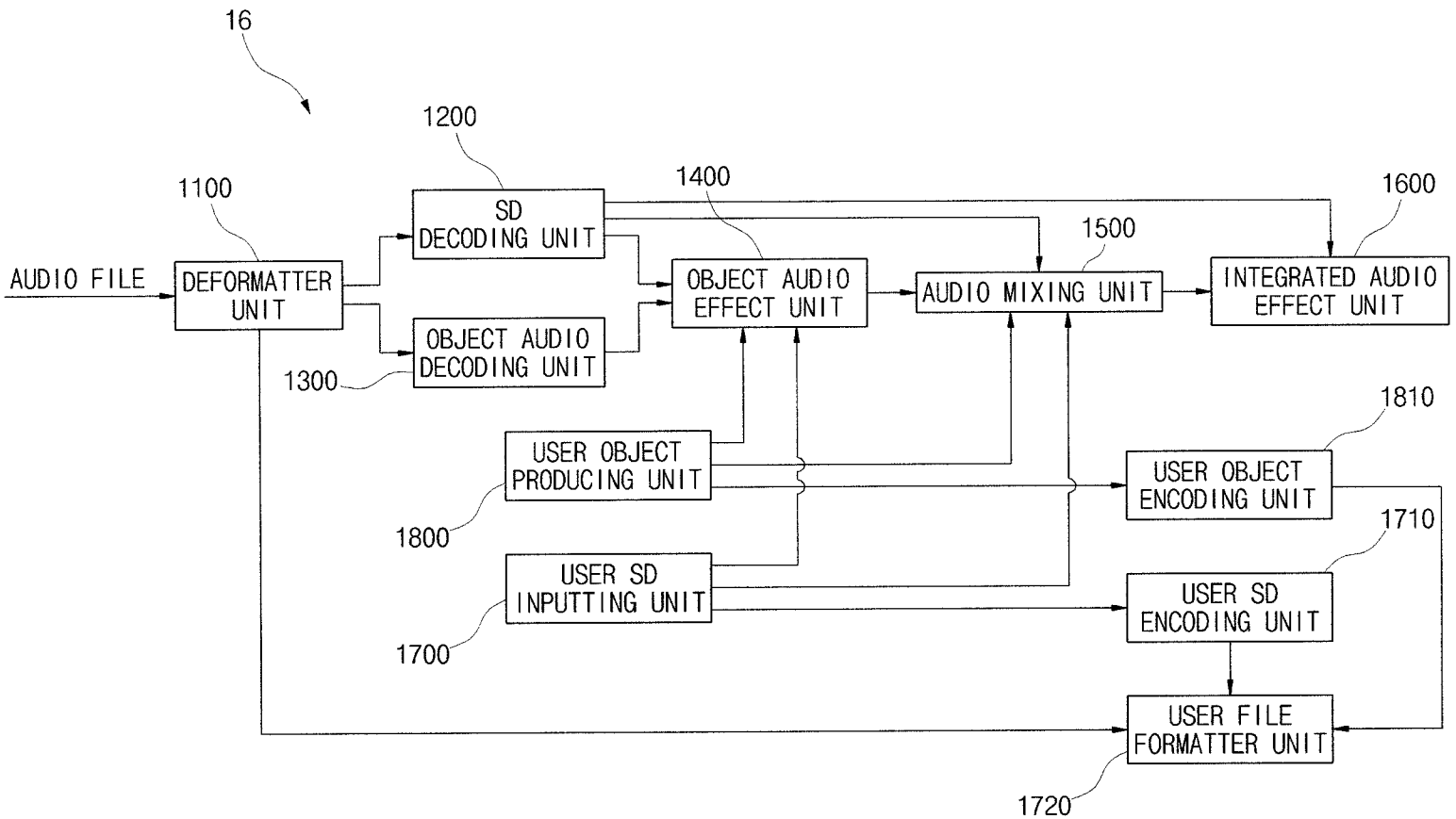
FIG. 8 is a block diagram showing an apparatus for playing realistic object audio according to yet another exemplary embodiment of the present invention.

FIG. 8 is a block diagram showing an apparatus for playing realistic object audio according to yet another exemplary embodiment of the present invention.

Meanwhile, the realistic object audio encoding apparatus according to the above-mentioned exemplary embodiments may be included as a part of the realistic object audio playing apparatus according to the exemplary embodiments of the present invention.

Accordingly, since the user can use the realistic object audio encoding apparatus together while using the realistic object audio producing apparatus, the user can edit, store, and play the realistic object audio signal at one time.

Referring to FIG. 8, a realistic object audio playing apparatus 16 includes a deformatter unit 1100, an SD decoding unit 1200, an object audio decoding unit 1300, an object audio effect unit 1400, an audio mixing unit 1500, an integrated audio effect unit 1600, a user SD inputting unit 1700, a user SD encoding unit 1710, a user file formatter unit 1720, a user object producing unit 1800, and a user object encoding unit 1810.

Herein, the same reference numerals are used with respect to components that perform the same functions as the components shown in FIGS. 4 and 5 and a detailed description of the corresponding components will be omitted.

The user SD inputting unit 1700 receives user SD information by user setting.

The user SD encoding unit 1710 encodes the user SD information to user SD compression data.

The user file formatter unit 1720 integrates SD compression data, object audio compression data, and user SD compression data into an audio file.

The user object producing unit 1800 adds object audio according to user input and stores a user object audio signal which is an audio signal of the added object audio.

The user object encoding unit 1810 encodes the user object audio signal into user object audio compression data.

Meanwhile, the user file formatter unit 1720 may integrate the SD compression data, the object audio compression data, and the user object audio compression data into the audio file.

Meanwhile, the object audio effect unit 1400 adds the audio effect for each object to the object audio signal according to the SD information for each object in the user SD information inputted from the user SD inputting unit 1700 to produce the realistic object audio signal corresponding to the object audio signal.

Further, the object audio effect unit 1400 may further receive the user object audio signal from the user object producing unit 1800 and add the audio effect for each object to the object audio signal according to the SD information for each object to produce the realistic object audio signal corresponding to each object audio signal.

Meanwhile, the audio mixing unit 1500 further receives the user object audio signal from the user object producing unit 1800 and may synthesize the corresponding user object audio signal into at least one sound.

Further, the audio mixing unit 1500 may synthesize each realistic object audio signal into at least one sound according to the object relationship SD information including the information representing the relative relationship between the objects in the user SD information inputted from the user SD inputting unit 1700.

Accordingly, the user may play various sounds by producing the realistic object audio signal for each object, and encode the inputted user SD information into the user SD compression data and add the user SD compression data to the inputted audio file by using the realistic object audio encoding apparatus. Further, the user may encode the inputted user object audio signal into the user object audio compression data and add the user object audio compression data to the inputted audio file by using the realistic object audio encoding apparatus.

Further, the user integrates the user SD information into the audio file to store the user SD information in the audio file and reuse the user SD information. Further, since the user can use the realistic object audio encoding apparatus together while using the realistic object audio producing apparatus, the user can edit, store, and play the realistic object audio signal at a time.

Figure 9:
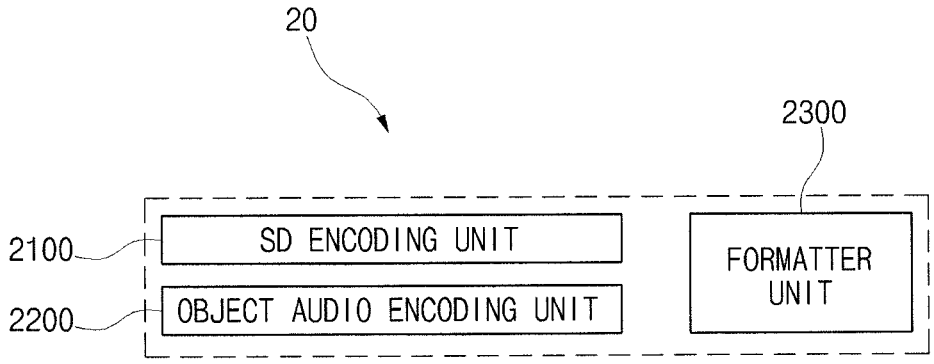
FIG. 9 is a block diagram showing an apparatus for producing realistic object audio according to an exemplary embodiment of the present invention.

FIG. 9 is a block diagram showing an apparatus for producing realistic object audio according to an exemplary embodiment of the present invention.

Referring to FIG. 9, a realistic object audio producing apparatus 20 includes an SD encoding unit 2100, an object audio encoding unit 2200, and a formatter unit 2300.

The SD encoding unit 2100 encodes scene description (SD) information for a 3D audio effect to produce SD compression data.

The object audio encoding unit 2200 encodes object audio signals which are the respective audio signals of a plurality of objects to produce object audio compression data.

The formatter unit 2300 integrates the SD compression data and the object audio compression data into an audio file.

Accordingly, the user can produce the realistic object audio for the 3D audio effect and encode and integrate the SD information and the object audio signals into the audio file.

Figure 10:
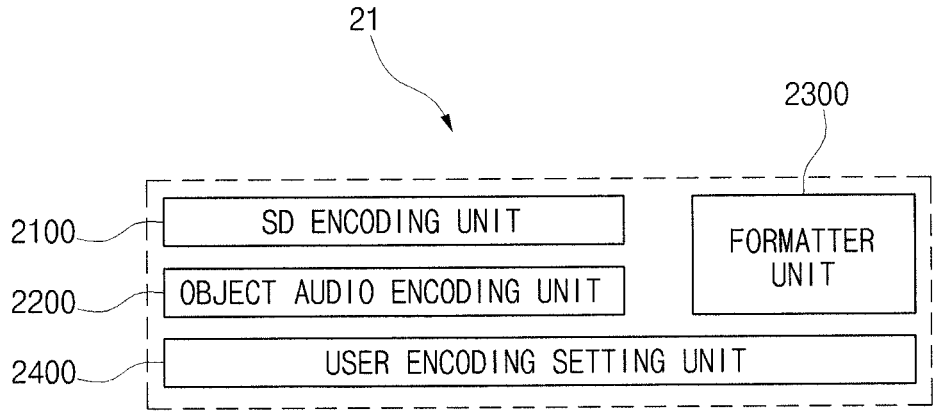
FIG. 10 is a block diagram showing an apparatus for producing realistic object audio according to another exemplary embodiment of the present invention.

FIG. 10 is a block diagram showing an apparatus for producing realistic object audio according to another exemplary embodiment of the present invention.

Referring to FIG. 10, a realistic object audio producing apparatus 21 includes an SD encoding unit 2100, an object audio encoding unit 2200, and a formatter unit 2300.

Further, the object audio encoding unit 2200 further includes a user encoding setting unit 2400 setting a type of an encoded codec according to user selection.

The SD encoding unit 2100 encodes the scene description (SD) information for the 3D audio effect to produce the SD compression data.

The object audio encoding unit 2200 encodes the object audio signals which are the respective audio signals of the plurality of objects to produce the object audio compression data.

The formatter unit 2300 integrates the SD compression data and the object audio compression data into the audio file.

Further, the formatter unit 2300 may integrate the SD compression data and the object audio compression data into the audio file according to the type of the codec selected by the user.

Meanwhile, the codec which can be selected by the user may merely encode the SD information and the object audio signal and is not limited to a format of the corresponding codec.

For example, as the SD compression data, MPEG-4 binary format for scenes (BIFs), MPEG-4 lightweight application scene representation (LASeR), and the like may be used.

Further, as the object audio compression data, audio codecs such as MPEG-1,2,2.5 layer 3 (MP3), advanced audio coding (AAC), MPEG-4 audio lossless coding (ALS), and the like may be used.

Figure 11:
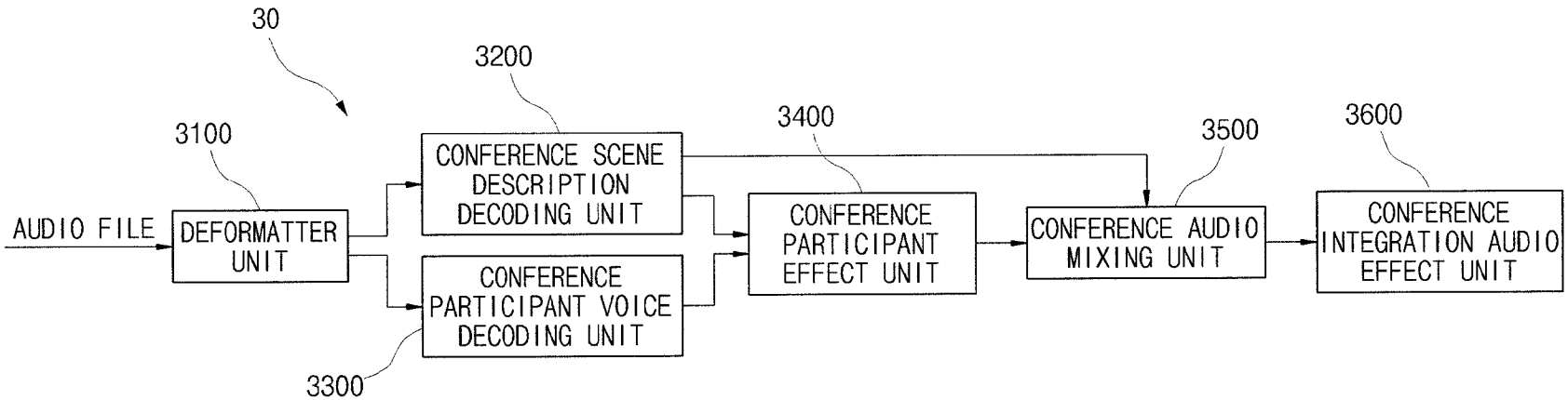
FIG. 11 is a block diagram showing an apparatus for playing conference audio according to an exemplary embodiment of the present invention.

FIG. 11 is a block diagram showing an apparatus for playing conference audio according to an exemplary embodiment of the present invention.

Referring to FIG. 11, a conference audio playing apparatus 30 includes a deformatter unit 3100, a conference SD decoding unit 3200, a conference participant voice decoding unit 3300, a conference participant effect unit 3400, a conference audio mixing unit 3500, and a conference integration audio effect unit 3600.

The deformatter unit 3100 individually separates conference SD compression data and conference participant voice compression data from inputted conference audio files.

The conference SD decoding unit 3200 decodes the conference SD compression data and produces conference SD information for a conference scene.

The conference participant voice decoding unit 3300 decodes the conference participant voice compression data and produces a plurality of conference participant voice signals.

The conference participant effect unit 3400 adds a conference audio effect to each conference participant voice signal according to the conference SD information to produce a conference participant audio signal.

The conference audio mixing unit 3500 synthesizes the conference participant audio signal into at least one sound according to the conference SD information.

The conference integration audio effect unit 3600 adds an integrated audio effect to the sound produced from the conference audio mixing unit 3500.

Meanwhile, the conference scene may be expressed by the conference SD information regarding seat layouts, conference tools, and the like.

The conference SD information may include at least one of conference control information, conference participant information, conference participant identification (ID) information, and conference participant's positional information.

The conference control information may include at least one of information controlling the conference participant voice signal and information controlling the conference tool.

For example, in the case where a microphone is used as the conference tool, the conference control information may include information controlling a power supply of the microphone and controlling volume.

The conference participant information is personal privacy-related information regarding names, sexes, and the like of conference participants.

The conference participant ID information is the ID information for discriminating any one conference participant from other conference participants.

The conference participant's positional information includes absolute positions and relative positions of the conference participants in a conference.

For example, the conference participant's positional information may be a coordinate for a predetermined seat on which the participant takes a seat in a conference room. Further, the participant may be positioned on a seat opposite to a conference master.

The conference participant voice signal is acquired by converting a voice of each conference participant into an audio signal. The signal may be provided from the microphone, and the like.

Therefore, the conference participant effect unit 3400 adds the conference audio effect to each conference participant voice signal according to the conference SD information to produce the conference participant audio signal.

For example, the conference SD information may include volume information of the microphone used by the participant, which corresponds to the voice signal of each conference participant.

Therefore, the user can play conference audio in which various conference audio effects are added to the voices of the conference participants by using the conference audio playing apparatus 30.

Figure 12:
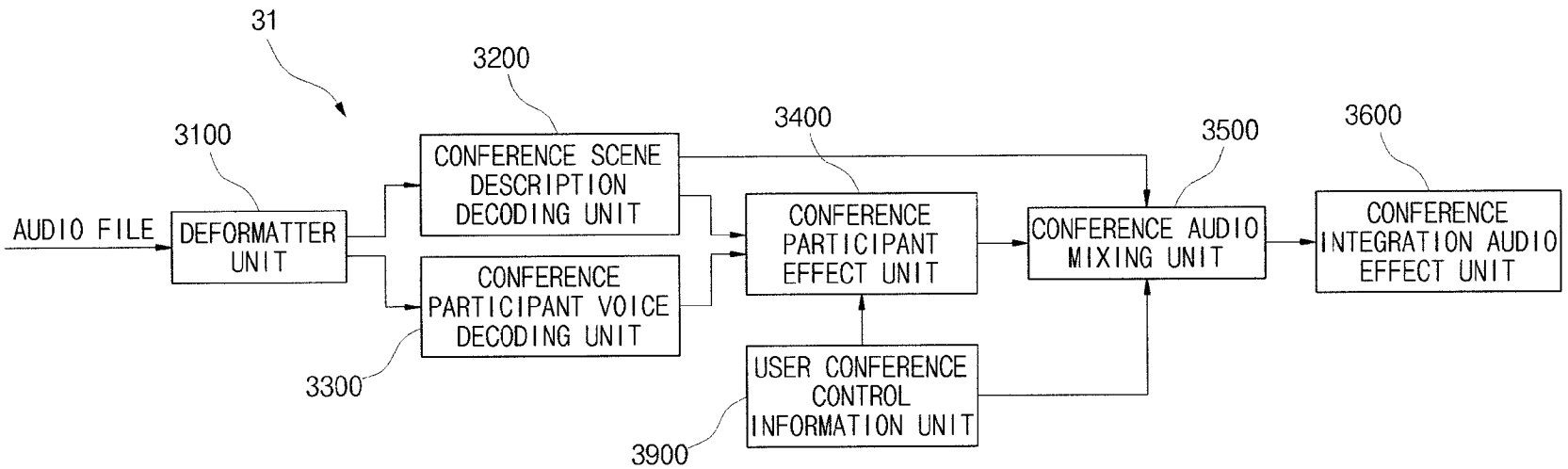
FIG. 12 is a block diagram showing an apparatus for playing conference audio according to another exemplary embodiment of the present invention.

FIG. 12 is a block diagram showing an apparatus for playing conference audio according to another exemplary embodiment of the present invention.

Herein, the same reference numerals are used with respect to components that perform the same functions as the components shown in FIG. 12 and a detailed description of the corresponding components will be omitted.

Referring to FIG. 12, a conference audio playing apparatus 31 includes a deformatter unit 3100, a conference SD decoding unit 3200, a conference participant voice decoding unit 3300, a conference participant effect unit 3400, a conference audio mixing unit 3500, and a conference integration audio effect unit 3600. Further, the conference audio playing apparatus 31 may further include a user conference control information unit 3900.

The user conference control information unit 3900 receives user conference control information including the information controlling the conference SD information, the conference participant voice signal, and the conference audio effect from the user.

Meanwhile, the conference participant effect unit 3400 may add the conference audio effect to produce the conference participant audio signal according to the user conference control information.

Further, the conference audio mixing unit 3500 may synthesize the conference participant audio signal into at least one sound according to the user conference control information.

Accordingly, the user may control the conference and add various conference audio effects to the conference participant audio signal by inputting the user conference control information.

Figure 13:
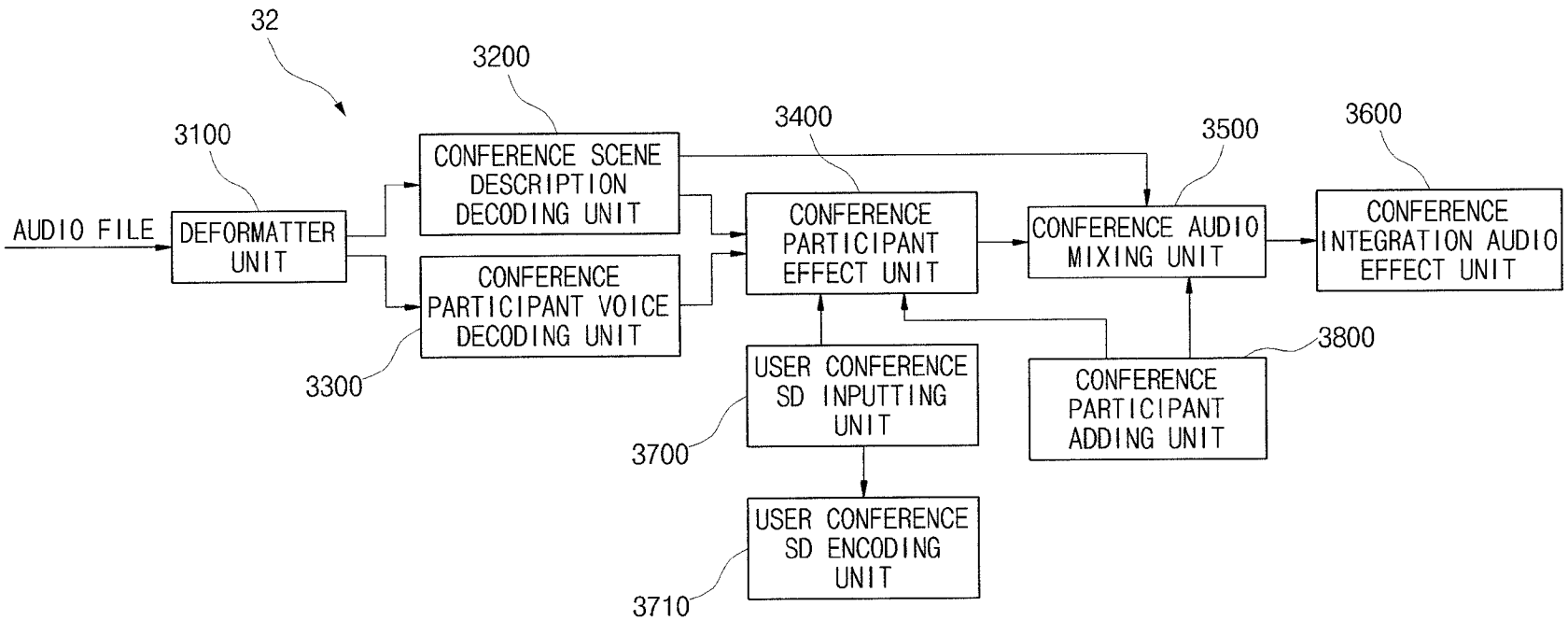
FIG. 13 is a block diagram showing an apparatus for playing conference audio according to yet another exemplary embodiment of the present invention.

FIG. 13 is a block diagram showing an apparatus for playing conference audio according to yet another exemplary embodiment of the present invention.

Herein, the same reference numerals are used with respect to components that perform the same functions as the components shown in FIG. 11 and a detailed description of the corresponding components will be omitted.

Referring to FIG. 13, a conference audio playing apparatus 32 may include a deformatter unit 3100, a conference SD decoding unit 3200, a conference participant voice decoding unit 3300, a conference participant effect unit 3400, a conference audio mixing unit 3500, and a conference integration audio effect unit 3600. Further, the conference audio playing apparatus 32 may further include a user conference SD inputting unit 3700, a user conference SD encoding unit 3710, and a conference participant adding unit 3800.

The user conference SD inputting unit 3700 receives the user conference SD information by user setting.

The user conference SD encoding unit 3710 encodes the user conference SD information into the conference SD compression data.

The conference participant adding unit 3800 adds a new conference participant by the user and stores a conference participant voice signal of the new conference participant.

Meanwhile, the conference participant effect unit 3400 may add the conference audio effect to produce the conference participant audio signal according to the user conference SD information.

Further, the conference audio mixing unit 3500 may further receive the conference participant voice signal of the new conference participant to synthesize the corresponding conference participant voice signal into at least one sound.

Accordingly, the user may control the conference and encode the user conference SD information to store and manage the encoded user conference SD information by inputting the user conference SD information. Further, the user may add the new conference participant and add various conference audio effects to the conference participant audio signal.

Figure 14:
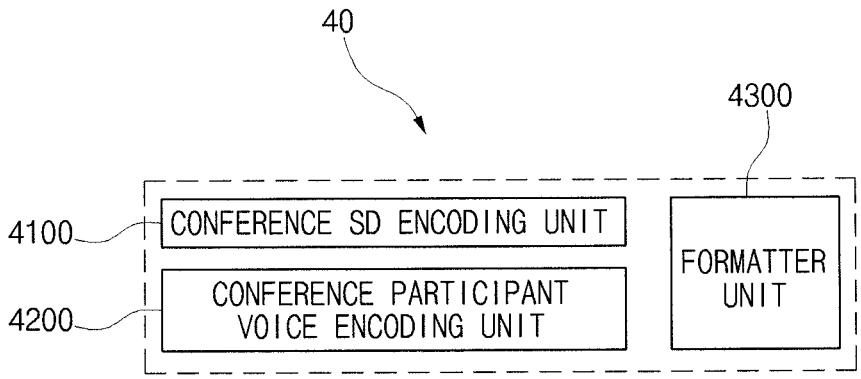
FIG. 14 is a block diagram showing an apparatus for producing conference audio according to an exemplary embodiment of the present invention.

FIG. 14 is a block diagram showing an apparatus for producing conference audio according to an exemplary embodiment of the present invention.

Referring to FIG. 14, a conference audio producing apparatus 40 includes a conference SD encoding unit 4100, a conference participant voice encoding unit 4200, and a formatter unit 4300.

The conference SD encoding unit 4100 encodes conference SD information regarding a conference scene to produce conference SD compression data.

The conference participant voice encoding unit 4200 encodes conference participant voice signals for voices of a plurality of conference participants to produce conference participant voice compression data.

The formatter unit 4300 integrates the conference SD compression data and the conference participant voice compression data into a conference audio file.

Accordingly, the user can produce the conference audio for the conference and encode and integrate the conference SD information and the conference participant voice signal into the audio file.

Figure 15:
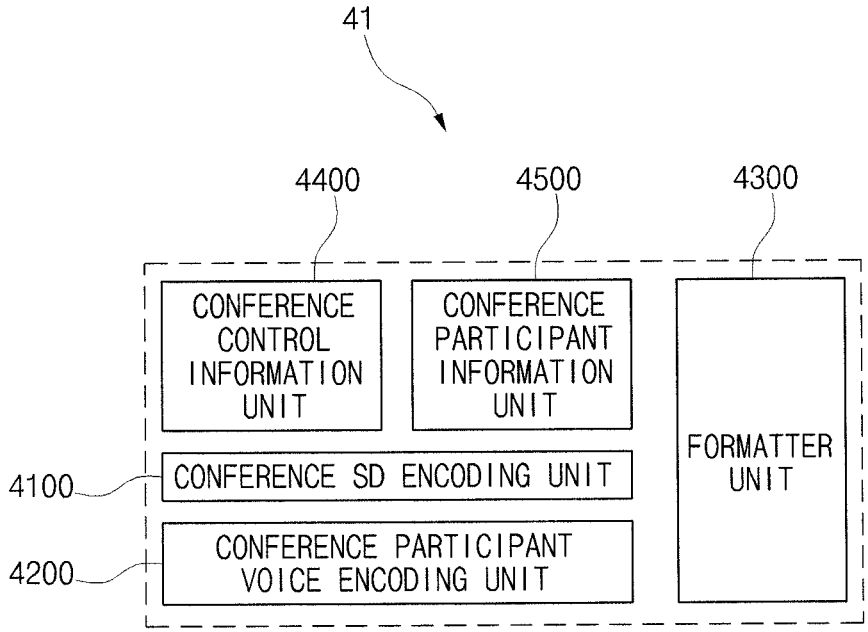
FIG. 15 is a block diagram showing an apparatus for producing conference audio according to another exemplary embodiment of the present invention.

FIG. 15 is a block diagram showing an apparatus for producing conference audio according to another exemplary embodiment of the present invention.

Referring to FIG. 15, a conference audio producing apparatus 41 according to another exemplary embodiment of the present invention includes a conference SD encoding unit 4100, a conference participant voice encoding unit 4200, and a formatter unit 4300 and may further include a conference control information unit 4400 and a conference participant information unit 4500.

The conference SD encoding unit 4100 encodes the conference SD information regarding the conference scene to produce the conference SD compression data.

The conference participant voice encoding unit 4200 encodes the conference participant voice signals for the voices of the plurality of conference participants to produce the conference participant voice compression data.

The formatter unit 4300 integrates the conference SD compression data and the conference participant voice compression data into the conference audio file.

The conference control information unit 4400 stores and manages conference control information controlling the conference.

The conference participant information unit 4500 stores and manages conference participant information regarding the conference participant.

Meanwhile, the conference SD encoding unit 4100 receives the conference control information and the conference participant information from the conference control information unit 4400 and the conference participant information unit 4500 and encodes the conference SD information regarding the conference scene to produce the conference SD compression data.

Accordingly, the user may separately store and manage the conference control information and the conference participant information and prevent the requisite conference control information and the conference participant information for producing the conference audio from being omitted from the conference audio file.

According to the exemplary embodiments of the present invention, since a user can a realistic object audio signal for each object through a realistic object audio playing apparatus, the user can play various sounds.

Further, the user can produce the realistic object audio signal by adding object audio according to user input in addition to an inputted audio file and play various sounds.

Furthermore, the user can produce the realistic object audio for a 3D audio effect through a realistic object audio producing apparatus and encodes and integrate SD information and an object audio signal into the audio file.

In addition, the user can play conference audio in which various conference audio effects are applied to voices of conference participants by using a conference audio playing apparatus.

In addition, the user can produce conference audio for a conference and encode and integrate conference SD information and voice signals of conference participants into the audio file, by using a conference audio producing apparatus.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An apparatus for playing realistic object audio, the apparatus comprising:

a deformatter unit individually separating scene description (SD) compression data and object audio compression data from inputted audio files;

an SD decoding unit decoding the SD compression data to restore SD information;

an object audio decoding unit decoding the object audio compression data to restore object audio signals which are respective audio signals of a plurality of objects;

an object audio effect unit adding an audio effect for each object to the object audio signals according to SD information for each object corresponding to the object audio signals among the restored SD information to produce a realistic object audio signal corresponding to each of the object audio signals;

an audio mixing unit synthesizing each of the realistic object audio signals into at least one sound;

wherein the audio mixing unit further receives a user object audio signal which is not included in the inputted audio files and synthesizes the received user object audio signal into the at least one sound.

2. The apparatus of claim 1, further comprising:

a user SD inputting unit receiving user SD information, wherein the object audio effect unit adds the audio effect for each object to the object audio signals according to the SD information for each object corresponding to the object audio signals among the received user SD information to produce the realistic object audio signal.

3. The apparatus of claim 1, further comprising:

an integrated audio effect unit adding an integrated audio effect to the at least one sound produced by the audio mixing unit.

4. The apparatus of claim 3, wherein the integrated audio effect unit receives the restored SD information from the SD decoding unit to add the integrated audio effect to the at least one sound produced by the audio mixing unit according to the restored SD information.

5. The apparatus of claim 3, further comprising:

a user object producing unit adding the user object audio signal according to user input and storing the user object audio signal which is an audio signal of the added user object audio signal.

6. The apparatus of claim 1, wherein the SD information for each object includes at least one of information regarding the number of audios for each object, name information of audio for each object, type information of audio for each object, effect information of audio for each object, effect application time information of audio for each object, volume information of audio for each object, angle and distance information of audio for each object, angle and distance information for an externalization effect of audio for each object, 3D effect information of audio for each object and parameter information for the 3D effect information, background information of audio for each object, application start time information of audio for each object, application termination time information of audio for each object, playing-related time information of audio for each object, and parameter information of audio for each object.

7. The apparatus of claim 1, wherein the deformatter unit individually separates the scene description (SD) compression data including conference SD information regarding a conference scene and the object audio compression data including voice signals of a plurality of conference participants from the inputted audio file.

8. The apparatus of claim 7, wherein the object audio effect unit adds a conference audio effect to the voice signals of the plurality of conference participants according to the conference SD information to produce the realistic object audio signal.

9. An apparatus for playing realistic object audio, the apparatus comprising:

an object audio effect unit receiving scene description (SD) information and adding an audio effect for each object to object audio signals according to SD information for each object corresponding to each of the object audio signals in the received SD information to produce a realistic object audio signal corresponding to each of the object audio signals;

an audio mixing unit synthesizing each of the realistic object audio signals into at least one sound; and a user object producing unit adding object audio according to user input and storing a user object audio signal which is an audio signal of the added object audio, wherein the audio mixing unit further receives the user object audio signal to synthesize the received user object audio signal into the at least one sound.

* * * * *